US008955928B2

(12) United States Patent
Cheng

(10) Patent No.: US 8,955,928 B2
(45) Date of Patent: Feb. 17, 2015

(54) JOINING CONNECTORS AND A RACK USING JOINING CONNECTORS

(71) Applicant: Kun-Lung Cheng, Taichung (TW)

(72) Inventor: Kun-Lung Cheng, Taichung (TW)

(73) Assignee: Donido Enterprise Co., Ltd., Taichung (TW)

( * ) Notice: Subject to any disclaimer, the term of this patent is extended or adjusted under 35 U.S.C. 154(b) by 0 days.

(21) Appl. No.: 14/015,067

(22) Filed: Aug. 30, 2013

(65) Prior Publication Data

US 2014/0069882 A1 Mar. 13, 2014

(30) Foreign Application Priority Data

Sep. 7, 2012 (TW) ..... 101217283 U

(51) Int. Cl.

| | |
|---|---|
| ***A47G 29/00*** | (2006.01) |
| ***A47F 5/00*** | (2006.01) |
| ***A47B 47/00*** | (2006.01) |
| *A47B 87/00* | (2006.01) |
| *F16B 12/00* | (2006.01) |
| *F16B 7/04* | (2006.01) |
| *F16D 1/00* | (2006.01) |
| *B65D 6/00* | (2006.01) |

(52) U.S. Cl.

CPC ..... *A47F 5/0018* (2013.01); *A47B 47/0033* (2013.01)

USPC ..... 312/265.2; 312/108; 312/111; 403/169; 403/217; 220/4.33

(58) Field of Classification Search

USPC ..... 211/183, 188, 194, 189, 182; 312/265.1–265.4, 257.1, 108, 107, 312/111; 403/169–176, 217–219; 220/4.28, 220/4.33

See application file for complete search history.

(56) References Cited

U.S. PATENT DOCUMENTS

| | | | | | |
|---|---|---|---|---|---|
| 1,281,856 | A | * | 10/1918 | Shaw | 446/112 |
| 2,168,911 | A | * | 8/1939 | Meyer | 403/205 |
| 2,847,237 | A | * | 8/1958 | Ackerman | 403/218 |
| 3,716,259 | A | * | 2/1973 | Weill et al. | 52/280 |
| 3,864,049 | A | * | 2/1975 | Ono | 403/171 |
| 3,913,289 | A | * | 10/1975 | Recker | 312/140 |
| 3,955,702 | A | * | 5/1976 | Lundy | 220/4.28 |
| 3,973,855 | A | * | 8/1976 | Florence | 403/171 |
| 4,065,890 | A | * | 1/1978 | Fenner | 52/27 |
| 4,124,958 | A | * | 11/1978 | Chiche | 312/140 |
| 4,323,319 | A | * | 4/1982 | Adams | 403/171 |
| 4,348,129 | A | * | 9/1982 | Conforti | 403/218 |
| 4,351,621 | A | * | 9/1982 | Liou | 403/217 |
| 4,455,102 | A | * | 6/1984 | Baroi et al. | 403/173 |
| 4,484,429 | A | * | 11/1984 | Stephenson | 52/655.2 |
| 4,493,425 | A | * | 1/1985 | Yoshida | 211/189 |

(Continued)

*Primary Examiner* — Joshua J Michener
*Assistant Examiner* — Devin Barnett
(74) *Attorney, Agent, or Firm* — Egbert Law Offices, PLLC

(57) ABSTRACT

A joining connector is provided which can be fitted by the turning part of the frame bar of the shelf board. The joining connector includes a base plate having inner and outer sides. Recessed joining parts are formed on the outer side and define a vertical and a horizontal wall. The vertical wall and horizontal wall can match the outer edge of the turning part of the frame bar. Limiting projections are formed on the outer side of the base plate in a preset concrete shape, and located on a position between but spaced from the vertical and horizontal walls of the recessed joining part, so that the turning part of the frame bar can be pushed and fitted into the recessed joining part from the direction of the outer side of the base plate, and the limiting projection can correspondingly limit the inner edge of the turning part.

1 Claim, 11 Drawing Sheets

(56) References Cited

U.S. PATENT DOCUMENTS

| | | | | | |
|---|---|---|---|---|---|
| 4,498,800 | A * | 2/1985 | Sielaff | 403/172 |
| 4,650,261 | A * | 3/1987 | Winter et al. | 312/140 |
| 4,930,930 | A * | 6/1990 | Coppa | 403/171 |
| 4,969,568 | A * | 11/1990 | Yoshida | 220/4.33 |
| 5,066,161 | A * | 11/1991 | Pinney | 403/172 |
| 5,466,057 | A * | 11/1995 | Blankenburg | 312/108 |
| 5,556,218 | A * | 9/1996 | Homer | 403/170 |
| 5,556,219 | A * | 9/1996 | Mason | 403/176 |
| 5,715,956 | A * | 2/1998 | Yoshida | 211/182 |
| 5,803,782 | A * | 9/1998 | Selton | 446/126 |
| 5,918,998 | A * | 7/1999 | Pourmand | 403/218 |
| 6,062,664 | A * | 5/2000 | Benner | 312/265.1 |
| D455,292 | S * | 4/2002 | Hardy et al. | D6/449 |
| 6,413,004 | B1 * | 7/2002 | Lin | 403/176 |
| 6,527,236 | B1 * | 3/2003 | Situ | 248/220.1 |
| 6,557,955 | B2 * | 5/2003 | Saravis | 312/111 |
| 6,669,036 | B1 * | 12/2003 | Yang et al. | 211/181.1 |
| 6,718,709 | B2 * | 4/2004 | Koutras et al. | 52/285.1 |
| D506,613 | S * | 6/2005 | Gusdorf | D3/304 |
| D550,484 | S * | 9/2007 | Bonatti et al. | D6/509 |
| D555,399 | S * | 11/2007 | Tsai | D6/478 |
| 7,604,133 | B2 * | 10/2009 | Tsai | 211/194 |
| 7,967,401 | B2 * | 6/2011 | Hsu | 312/257.1 |
| 8,051,535 | B2 * | 11/2011 | Cheng | 16/82 |
| 8,147,009 | B1 * | 4/2012 | Rider | 312/257.1 |
| 8,186,776 | B2 * | 5/2012 | Zalewski | 312/111 |
| 8,528,291 | B2 * | 9/2013 | Allred et al. | 52/655.1 |
| 8,585,312 | B1 * | 11/2013 | Kosak | 403/171 |
| 2004/0131416 | A1 * | 7/2004 | Wu et al. | 403/170 |
| 2005/0006991 | A1 * | 1/2005 | Saravis | 312/111 |
| 2005/0104483 | A1 * | 5/2005 | Saravis | 312/111 |
| 2009/0166356 | A1 * | 7/2009 | Tsai | 220/4.01 |
| 2010/0277045 | A1 * | 11/2010 | Cheng | 312/263 |
| 2012/0009010 | A1 * | 1/2012 | Wu | 403/217 |
| 2012/0170972 | A1 * | 7/2012 | Song | 403/169 |
| 2013/0045042 | A1 * | 2/2013 | Ohlson | 403/171 |

* cited by examiner

JOINING CONNECTORS AND A RACK USING JOINING CONNECTORS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO APPENDIX SUBMITTED ON COMPACT DISC

Not applicable.

BACKGROUND OF THE INVENTION

1. Field of the Invention

The present invention relates generally to a kind of joining connectors, and more particularly to an innovative design, through which, when the joining connectors are used in a combined placing rack, the shelf boards of the shelf can be easily turned vertically or horizontally.

2. Description of Related Art Including Information Disclosed Under 37 CFR 1.97 and 37 CFR 1.98

Combined placing rack products ("racks") are commonly used in such places as the office or home. The structure of an ordinary rack is made up of a plurality of joining connectors and shelf boards which can be fitted into the joining connectors. As such racks can be easily assembled or disassembled, and various shapes of cabinets can be assembled based on the user's varied needs, they provide a great convenience for the users.

As regards the structure of the joining connectors of conventional rack, in most cases, one side of the joining connector is formed with vertical and horizontal crossing partition boards, and between the partition boards, inserting slots are formed for the edges of shelf boards to be fitted into. In addition, the periphery of the joining connectors are usually provided with inserting slots, so that the boards can be fitted from the vertical direction, and the shelf boards can be joined crosswise, lengthwise, or vertically to form a combined rack to place articles. However, although such racks are convenient in use, assembly and disassembly, the structure of conventional joining connectors makes it impossible for the placing rack to be additionally installed with rotatable shelf boards. When the shelf boards are fitted into the slots of the joining connectors, they can not be turned. Some manufacturers provide a shaft on one end of the shelf board to act as a pivot, but when the shaft is fitted into the inserting slot, the shelf board can only be turned in one direction, so the user is still unable to open the shelf board from other directions as needed. The flexibility and convenience is limited. Therefore, although the structure of conventional rack has been used for many years, the above problem is still not solved. In the current market, rack products are more and more diversified and competition is fierce. It shall be a target and goal for related manufacturers to develop an innovative structure with more convenience and practicability.

Thus, to overcome the aforementioned problems of the prior art, it would be an advancement if the art to provide an improved structure that can significantly improve the efficacy.

Therefore, the inventor has provided the present invention of practicability after deliberate design and evaluation based on years of experience in the production, development and design of related products.

BRIEF SUMMARY OF THE INVENTION

The present invention of "joining connectors and a rack using joining connectors" is characterized mainly by the recessed joining parts and limiting projections formed on the joining connectors. Compared to prior art, the present invention realizes some advancement. When the turning part of the frame bar is pushed and fitted between the recessed joining part and the limiting projection, the shelf board can be turned with the turning part on one side of the frame bar as the axle, and the turning part on the other side can escape from the recessed joining part and limiting projection, so that the shelf board can be freely turned in the vertical or horizontal direction. This realizes a rack product with its panel rotatable in different directions. The user can open the shelf board freely in any direction as needed. This greatly enhances the convenience and flexibility in opening the shelf board.

Although the invention has been explained in relation to its preferred embodiment, it is to be understood that many other possible modifications and variations can be made without departing from the spirit and scope of the invention as hereinafter claimed.

DETAILED DESCRIPTION OF THE INVENTION

Figure 1:
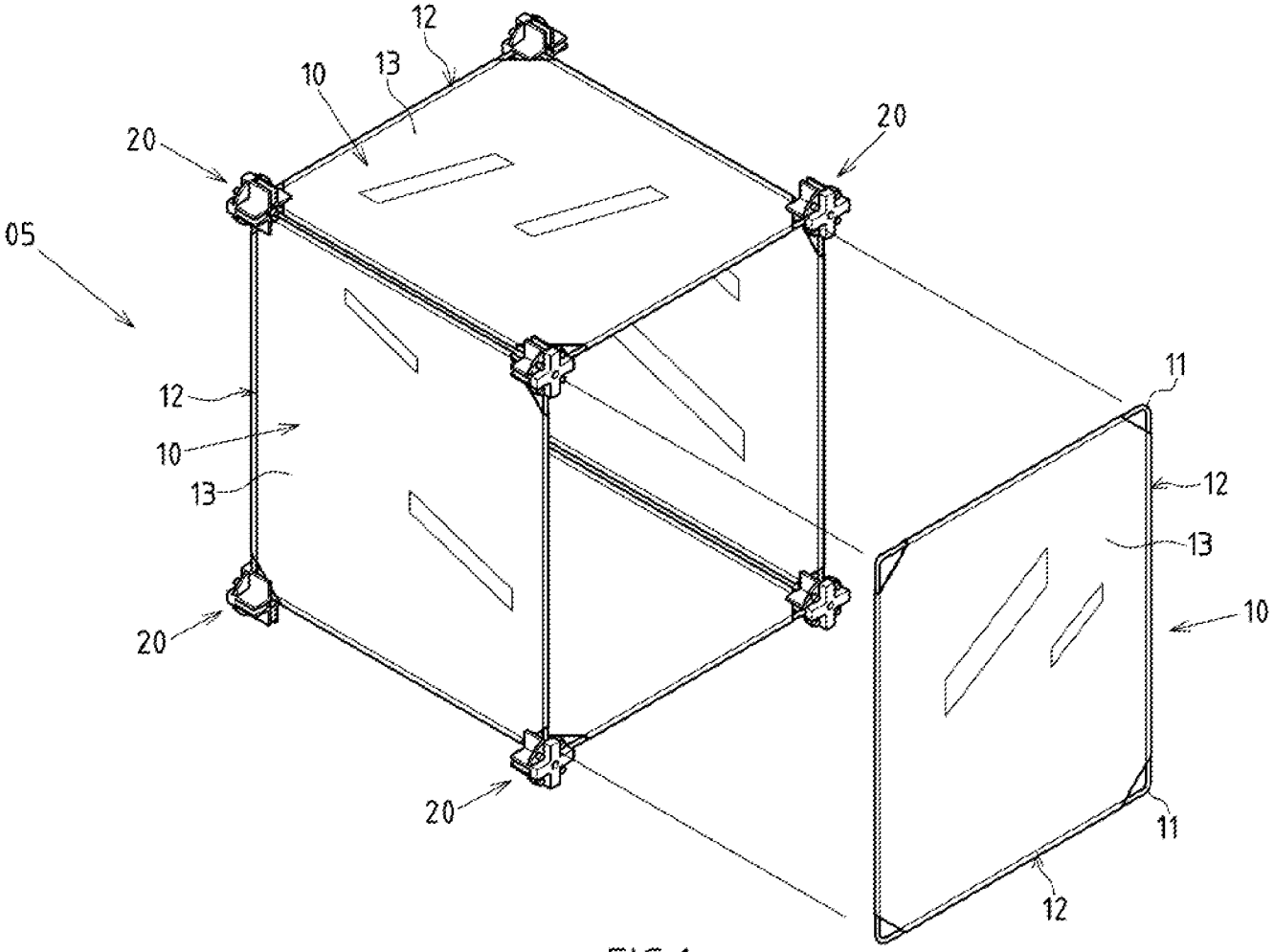
FIG. 1 is an exploded perspective view of the combined placing rack.
Figure 2:
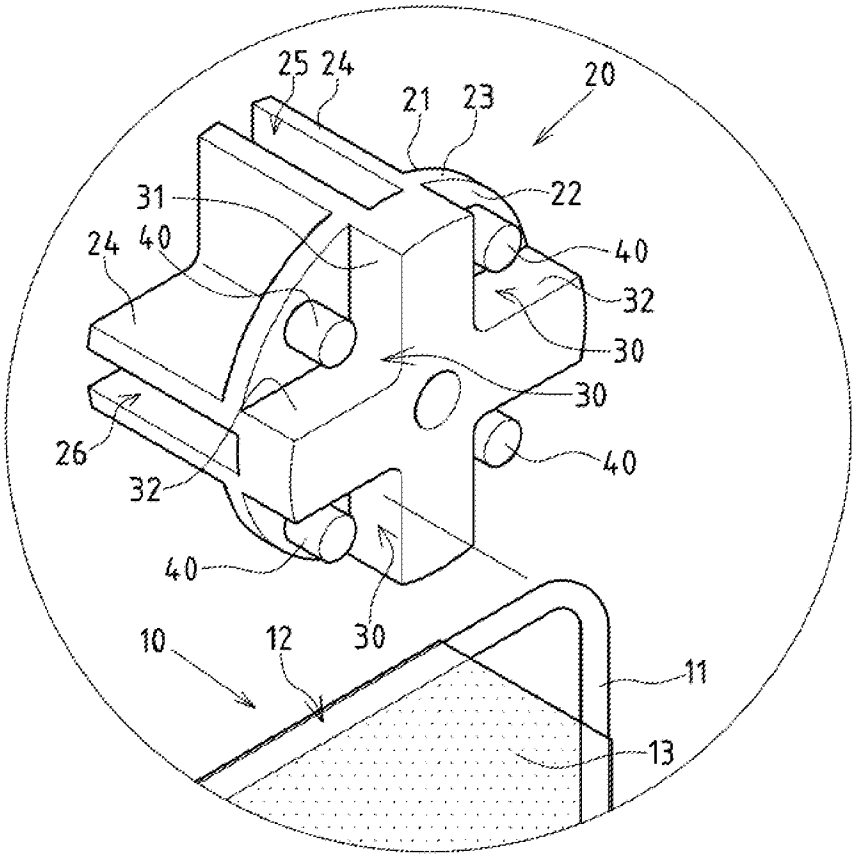
FIG. 2 is an exploded and partially enlarged view of the fitting state of the joining connectors.

FIGS. 1-6 depict preferred embodiments of the present invention of joining connectors and the combined placing rack using the joining connectors. However, such embodiments are illustrative only and shall not be limiting to the patent application. Said joining connector 20 can be fitted by the turning part 11 formed on the frame bar 12 of a shelf board 10.

Said joining connector 20 comprises a base plate 23, which has an inner side 21 and an outer side 22. The inner side 21 of the base plate 23 has parallel partition boards 24 in the vertical and horizontal directions. In between the partition boards 24, a vertical inserting slot 25 and a horizontal inserting slot 26 are defined. The vertical and horizontal inserting slots 25, 26 can be fitted by the turning part 11 of the frame bar 12.

A plurality of recessed joining parts 30 are formed on the outer side 22 of the base plate 10 in a recessed style and defining a vertical wall 31 and a horizontal wall 32. The vertical wall 31 and horizontal wall 32 can match the outer edge of the turning part 11 of the frame bar 12.

A plurality of limiting projections 40 are formed on the outer side 22 of the base plate 21 in a preset concrete shape, and located on a position between but spaced from the vertical and horizontal walls 31, 32 of the recessed joining part 30. In application, the limiting projection 40 can be in the shape of a bar or a block and the section of the limiting projection 40 can be in any style of round, half round, rectangular, polygonal, or curved shapes. This part is not limited and other embodiments will be described later.

Figure 3:
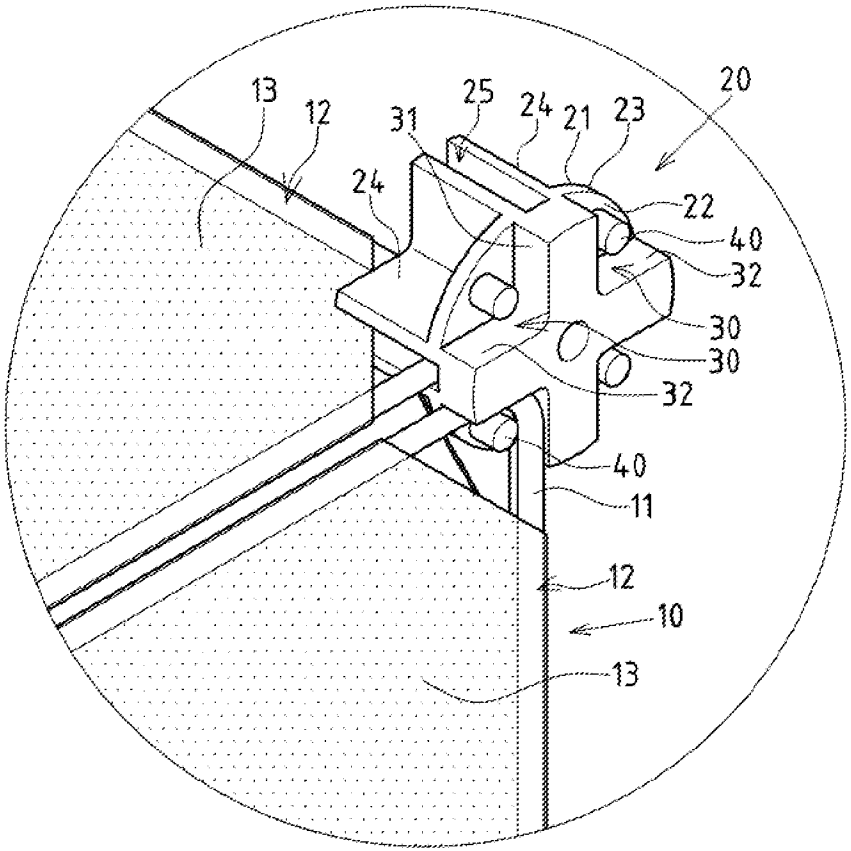
FIG. 3 is an assembled and partially enlarged view of the fitting state of the joining connectors.

The space shape of the recessed joining part 30 formed on the outer side 22 of the base plate 23 makes it possible for the turning part 11 of the frame bar 12 to be pushed into the recessed joining part 30 (as shown in FIG. 3) from the direction of the outer side 22 of the base plate 23, and the limiting projection 40 can correspondingly limit the inner edge of the turning part 11.

Based on the above-mentioned design, another core design of the present invention is to provide a combined placing rack 05. The rack 05 uses the above-mentioned joining connector 20.

Said combined placing rack 05 comprises a plurality of shelf boards 10 and a plurality of joining connectors 20 (i.e., the above-disclosed and described joining connectors 20). Each of the shelf boards 10 includes a rectangular frame bar 12 with multiple turning parts 11 and a panel 13 covering the frame bar 12. The turning parts 11 of the frame bar 12 are exposed outside the end angle of the panel 13.

Based on the structure wherein the turning part 11 of the frame bar 12 can be pushed to fit between the recessed joining part 30 and limiting projection 40, the shelf board 10 can be turned with the turning part 11 of one side of the frame bar 12 being the axle, making it possible for the turning part 11 of the other side to escape from the recessed joining part 30 and limiting projections 40, and be turned freely toward the vertical or horizontal direction. This realizes a combined placing rack 05 product with shelf boards rotatable toward different directions. The user can open the shelf board 10 from any direction as needed. This provides a great convenience to the user.

Figure 7:
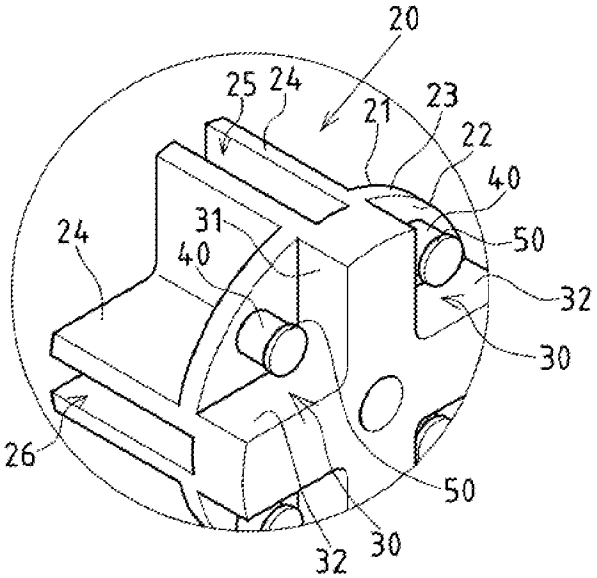
FIG. 7 is a partially enlarged view of the embodiment of the limiting projection.

The implementation of the present invention is described as below:

At least any one of the limiting projection 40, vertical wall 31 or horizontal wall 32 can be configured with an auxiliary retaining, edge 50 at a preset position. Firstly, referring to FIG. 7 as an example, the auxiliary retaining edge 50 is configured on the end of the limiting projection 40 in an expanding shape (in this embodiment, the auxiliary retaining edge 50 is formed on the end of the limiting projection 40, but it is not limited to this position), so that the turning part 11 of the frame bar 12 can be retained when it is pushed and fitted into the recessed joining part 30, to avid falling-off.

Figure 8:
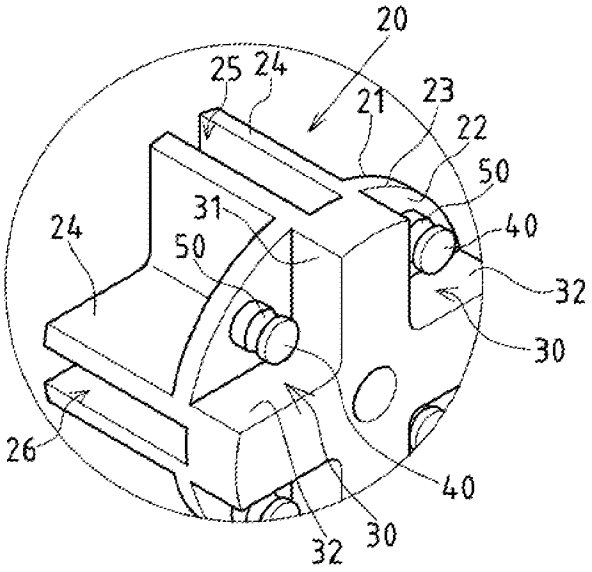
FIG. 8 is a partially enlarged view of the embodiment of the limiting projection.

Or, as in another embodiment of the present invention depicted in FIG. 8, the auxiliary retaining edge 50 is configured on the middle section of the limiting projection 40 in a grooving shape, so that the turning part 11 of the frame bar 12 can be similarly retained when it is pushed and fitted into the recessed joining part 30; Here, the grooving, auxiliary retaining edge 50 can be a ring groove or a partial groove.

Figure 9:
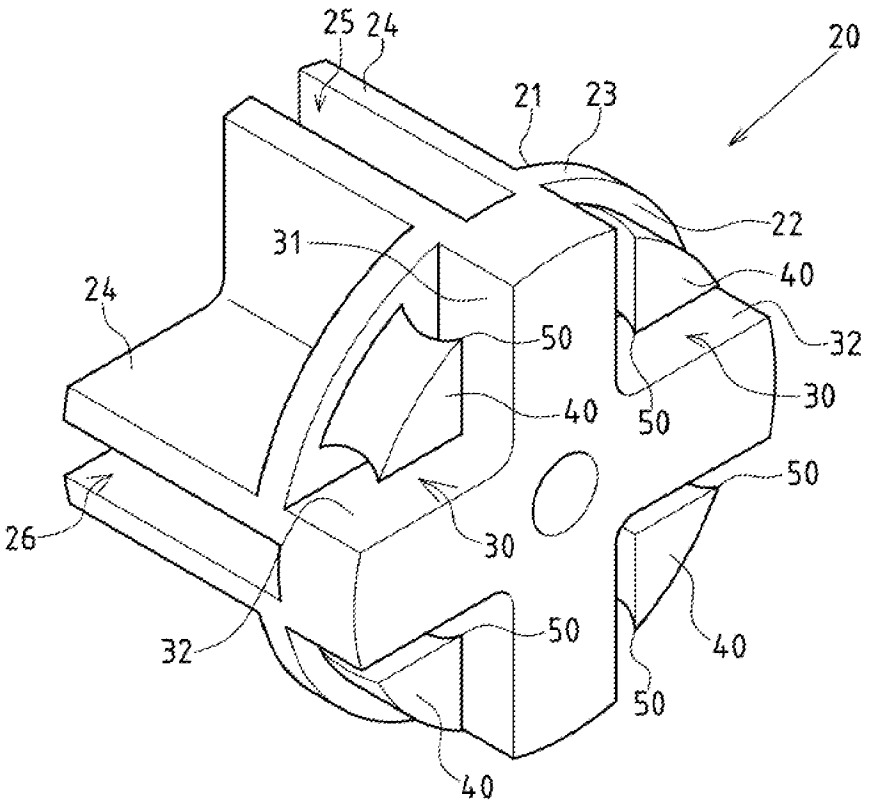
FIG. 9 is a perspective view of the embodiment of the bunting projection.

Alternatively, as shown in FIG. 9, the limiting projection 40 is in the form of a fan-shaped block, and the auxiliary retaining edge 50 is formed on the inner side of the limiting projection 40 corresponding to the vertical wall 31 and horizontal wall 32 (being concave as an example). With such a structure, the fitting state of the turning part 11 of the frame bar 12 can also be retained.

Figure 10:
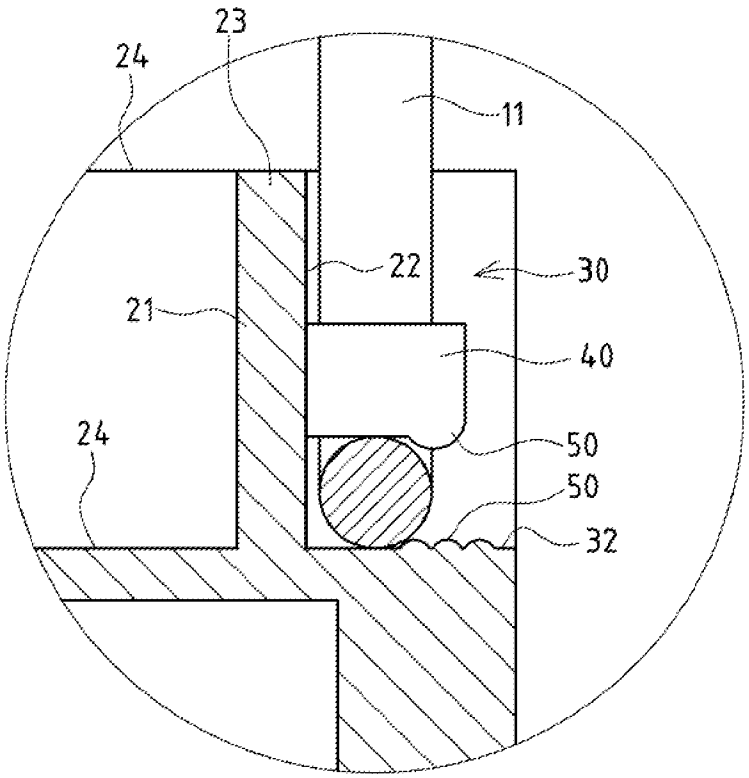
FIG. 10 is a sectional view of the present invention with auxiliary retaining edges configured at relative positions on the limiting projection, vertical wall, and horizontal wall.
Figure 11:
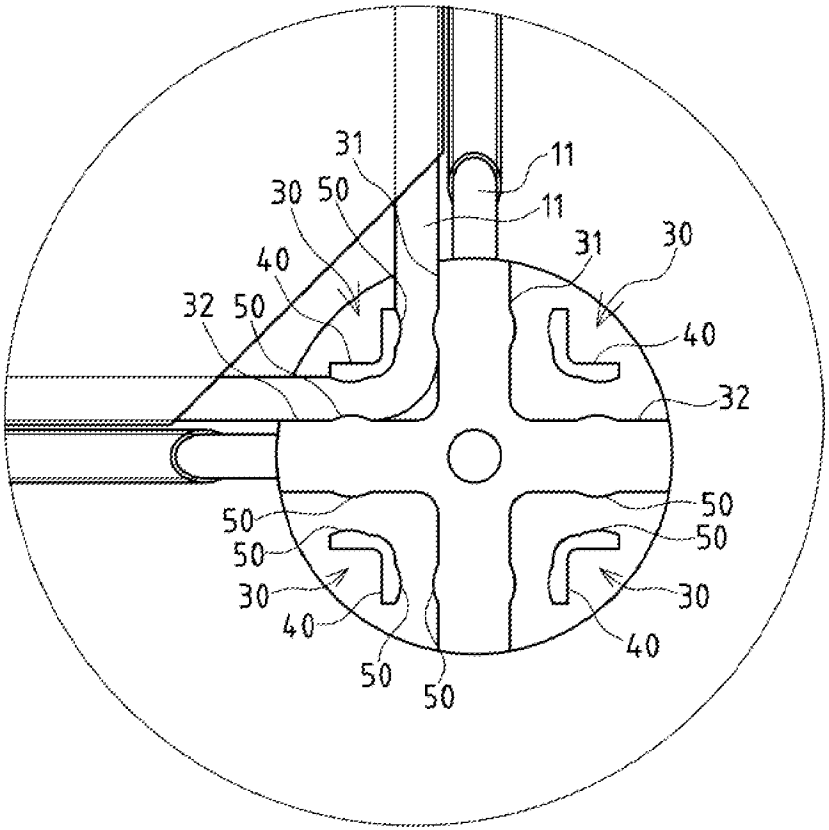
FIG. 11 is a partially enlarged and sectional view of the embodiment of the limiting projection.

FIG. 10 discloses another embodiment of the present invention, wherein the auxiliary retaining edges 50 are configured on the relative positions on the limiting projection 40 and the horizontal wall 32, so that the turning part 11 of the frame bar 12 can be retained when it is pushed and fitted into the recessed joining parts 30, making the fitting state of the turning part 11 more stable.

Figure 13:
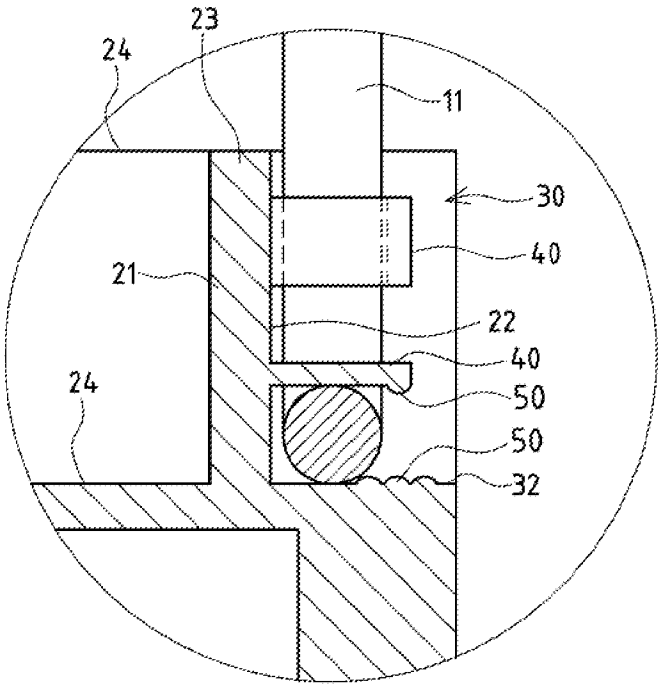
FIG. 13 is a partially enlarged and sectional view from another angle based on FIG. 11.
Figure 12:
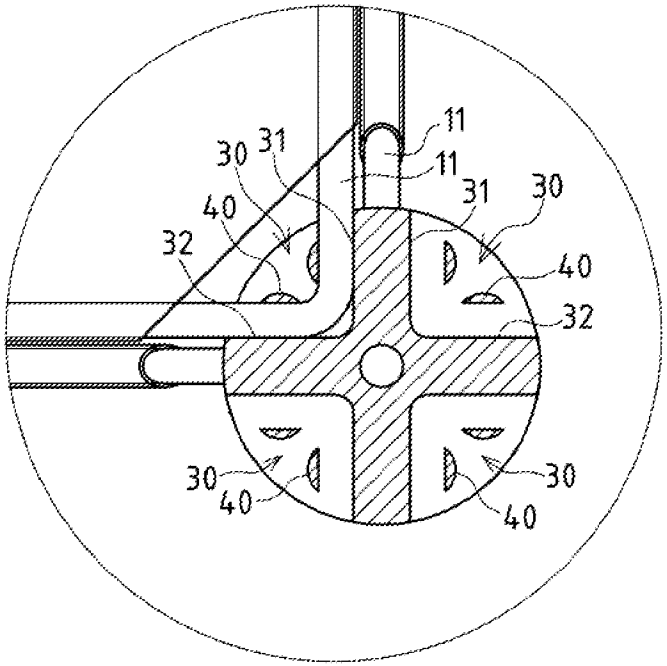
FIG. 12 is a partially enlarged and sectional view of the embodiment of the limiting projection.

Referring to FIG. 1, the section of the limiting projection 40 is in an L shape, so that the limiting projection 40 can retain the intersecting two sides of the inner edge of the turning part 11. Meanwhile, in this embodiment, the auxiliary retaining edges 50 are configured on the relative positions of the limiting projection 40 and the vertical wall 31 and the horizontal wall 32, to strengthen the retaining effect. As shown in FIGS. 12 and 13, the limiting projections 40 are in the form of two intersecting blocks, which can also retain the intersecting two sides of the inner edge of the turning part 11 to strengthen the retaining elect. Moreover, the configuration position of the auxiliary retaining edge 50 can be as disclosed above and is not detailed here.

It is to be additionally noted that the combined placing rack 05 and joining connectors 20 of the present invention can be exhibited and sold in the market as a whole assembly of the combined placing rack 05 or only as spare parts of joining connectors 20. Hence, no matter it is an exhibition and sale of spare parts or of combined placing rack 05, they all fall within the scope defined by the present invention.

The structure described above constitutes the design of the present invention. Below is a description regarding how the invention works.

Figure 4:
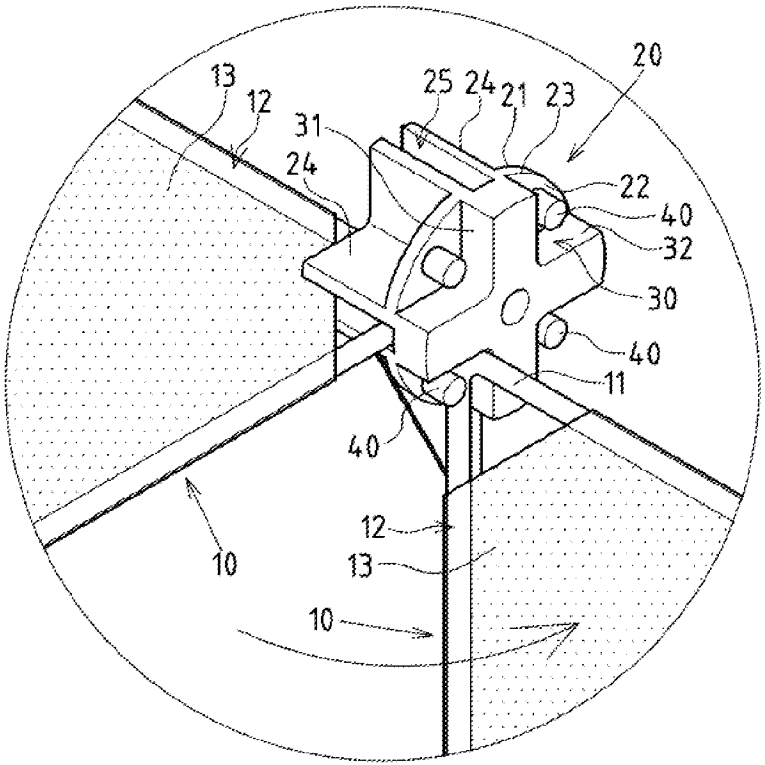
FIG. 4 is a moving state view of the rotating shelf board.
Figure 5:
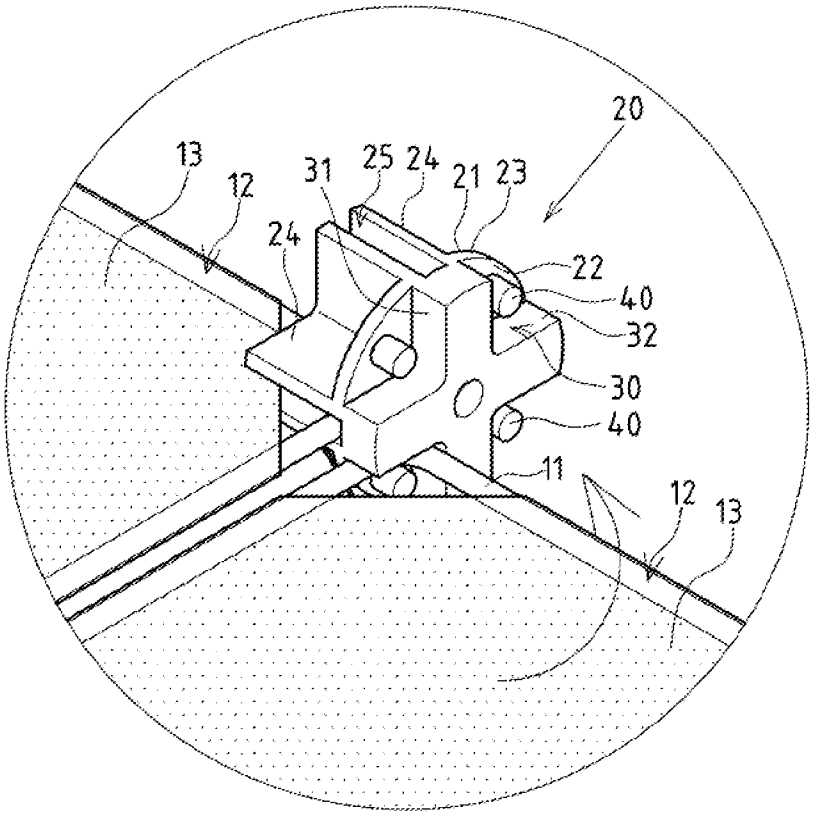
FIG. 5 is a moving state view of the rotating shelf board.
Figure 6:
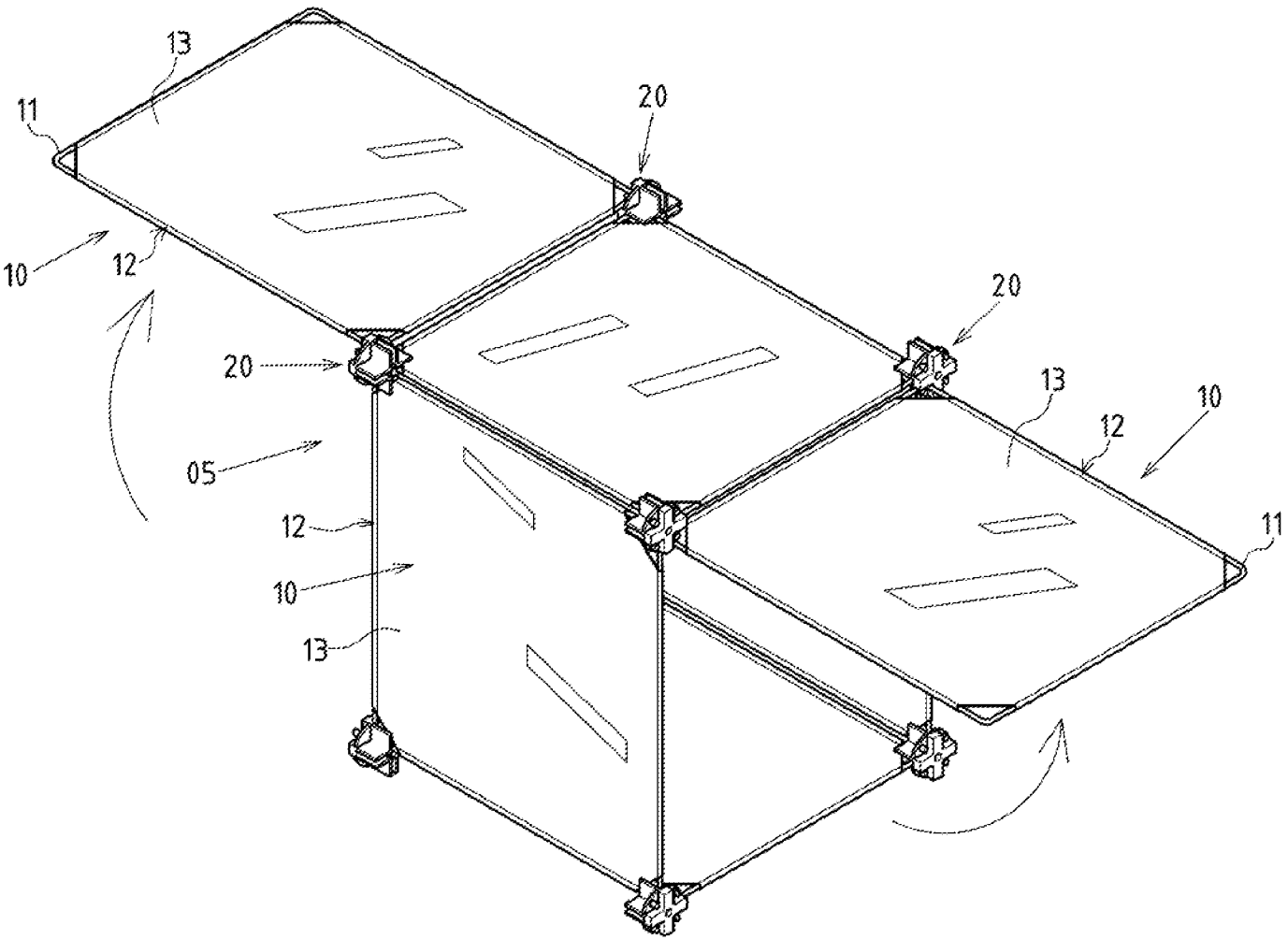
FIG. 6 is a moving state view of the rotating shelf board.

Referring to FIG. 3-6, with the combined placing rack 05 of the present invention as an example, when the turning part 11 formed on the frame bar 12 of the shelf board 10 is pushed and fitted between the recessed joining part 30 and the limiting projection 40, if the shelf board 10 is deemed as a panel, the shelf board 10 can be turned with the turning part 11 on either side of the frame bar 12 as the axle, and the turning part 11 on the other side can escape from the recessed joining parts 30 and the limiting projection 40, so that the panel can be freely turned in the vertical or horizontal direction, as shown in FIG. 4, it is turned in the horizontal direction (turned to left or right), or as shown in FIG. 6, two different shelf boards 10 are both turned in the vertical direction. The two shelf boards 10 can also be turned in different directions (not shown in the drawing). In this way, the user can turn the shelf boards 10 freely in any direction as needed. Hence, comparing to the structure of conventional combined racks with the panel rotatable only in one direction, the present invention is more convenient and flexible. it greatly enhances the easiness of turning the shelf boards 10 and practicability of the product.

I claim:

1. A modular placing rack, comprising:

a plurality of shelf boards, each of the shelf boards includes a rectangular frame bar having corners with turning parts and a panel covering a mid section of the frame bar, wherein a substantially triangular opening is located between each corner or turning part of the frame bar and an end angle of the panel at each corner of the panel;

a plurality of joining connectors, each of the joining connectors has a base plate with an inner side and an outer side, the inner side of each base plate has parallel partition boards extending in a vertical direction and parallel partition boards extending in a horizontal direction, wherein a vertical inserting slot and a horizontal inserting slot are defined between the respective partition boards, and a plurality of recessed joining parts are formed on the outer side of each base plate in a recessed style to define a vertical wall and a horizontal wall, wherein corresponding turning parts of the shelf boards are received by the vertical and horizontal inserting slots bar of a corresponding joining connector to form side walls of the modular rack, and the vertical walls and the horizontal walls are sized and shaped to match an outer edge of the turning parts of the frame bars; wherein a plurality of limiting projections are formed on the outer side of each base plate in a preset concrete shape, wherein one limiting projection from said plurality of limiting projections is located between and spaced from each vertical and horizontal wall of the recessed joining parts, wherein the shape of the recessed joining parts formed on the outer side of each base plate allows for a corresponding turning part of a corresponding shelf board to be pushed into a respective recessed joining part of a respestive joining connector from a direction corresponding to the outer side of the respective base plate, and a corresponding limiting projection is received by a corresponding opening of the corresponding shelf board to limit an inner edge of the corresponding turning part so that the corresponding shelf board is prevented from sliding off the respective joining connector in a lateral or longitudinal direction when the corresponding shelf board is pushed into the respective recessed joining part, wherein, when in use, the corresponding shelf board that was pushed into the respective recessed joining part can be rotated with the corresponding turning part the corresponding shelf board within the respective recessed joining part so as to allow a second corresponding turning part on an opposite side of the corresponding shelf board to escape from a corresponding recessed joining part and a corresponding limiting projection of another respective joining connector so the corresponding shelf board can turn freely toward the vertical or horizontal direction without interference from corresponding limiting projections.

* * * * *